US007517216B2

(12) United States Patent
Levesque

(10) Patent No.: US 7,517,216 B2
(45) Date of Patent: Apr. 14, 2009

(54) METHOD AND DEVICE FOR EXTINGUISHING A CANDLE

(76) Inventor: Alfred B. Levesque, 3960 Grape St., Denver, CO (US) 80207

( * ) Notice: Subject to any disclaimer, the term of this patent is extended or adjusted under 35 U.S.C. 154(b) by 437 days.

(21) Appl. No.: 11/331,641

(22) Filed: Jan. 13, 2006

(65) Prior Publication Data

US 2007/0166654 A1 Jul. 19, 2007

(51) Int. Cl.
*F23Q 25/00* (2006.01)

(52) U.S. Cl. ..... 431/144; 431/33

(58) Field of Classification Search ..... 431/144, 431/33, 34, 35, 6, 12, 289, 315; 169/46, 169/47, 54

See application file for complete search history.

(56) References Cited

U.S. PATENT DOCUMENTS 767,892 A 8/1904 Isakson
1,822,652 A 9/1931 Gluckert
3,985,492 A 10/1976 Nunemaker
4,497,374 A 2/1985 Millar
5,282,737 A 2/1994 Ray
5,820,360 A 10/1998 Callahan
5,971,081 A 10/1999 Stewart
5,989,012 A 11/1999 Umfleet
6,243,954 B1 * 6/2001 Bowers ..... 30/233
6,298,922 B1 10/2001 Stewart
6,435,858 B1 * 8/2002 Cormier et al. ..... 431/120
6,619,950 B2 9/2003 Ricci
6,799,965 B1 10/2004 Gaudioso
6,805,551 B1 10/2004 Feuer
6,960,074 B1 11/2005 Donoso
7,086,752 B1 8/2006 Feuer

FOREIGN PATENT DOCUMENTS

WO 03/061914 A1 7/2003

* cited by examiner

*Primary Examiner*—Alfred Basichas
(74) *Attorney, Agent, or Firm*—Marsh Fischmann & Breyfogle LLP

(57) ABSTRACT

An apparatus useful for extinguishing a flame of a candle, with preparation of the candlewick for relighting, is single-hand grippable and adapted for use to apply candle wax, or another candle fuel material, to a surface of a burning candlewick. Methods are also provided for extinguishing a flame of a candle involving applying a covering of a candle body material, such as candle wax, to the candlewick.

16 Claims, 7 Drawing Sheets

METHOD AND DEVICE FOR EXTINGUISHING A CANDLE

FIELD OF THE INVENTION

The invention relates to extinguishment of candles, and apparatus and methods useful in relation thereto.

BACKGROUND OF THE INVENTION

Candles generally have a body containing fuel material, typically a candle wax, and a candlewick axially embedded in the candle body and extending out of at least one end of the candle body. The exposed end of the candlewick extending out of the candle body may be lit to support a burning flame. Fuel material from the candle body travels into and through the candlewick and is consumed in the flame.

Candles have historically been widely used to provide light. Today, candles are often burned for aesthetic reasons. One significant problem with candles is that when the flame on the candle is extinguished, the candle often emits significant smoke following extinguishment. This smoke can have an unpleasant odor and can be irritating, significantly detracting from a user's aesthetic experience with the candle. Another significant problem is that between lightings, candlewicks are susceptible to being easily bent and deformed to a position that is difficult to access for relighting.

Significant effort has been devoted to modifying the performance of candles. Different waxes may be used to impart different visual appearance to the candle body or to impart different flame characteristics. Also, one or more of a variety of additives may be added to the candle body. Nonlimiting examples of some additives include stearic acid, vybar, luster crystals, clear crystals, plastic additives, microcrystalline wax additives, UV inhibitors and mineral oil. Many of these additives are designed to modify the melting characteristics of the candle body, the flame characteristics, or the visual appearance of the candle body.

There has also been significant effort directed to devising extinguishers for extinguishing flames on candles for safety or convenience, such as extinguishment without spraying melted wax or burning people in the process.

There are still significant needs, however, for products and techniques that address the problems of smoke production following candle extinguishment and of the susceptibility of candlewicks to become bent or otherwise deformed between lightings. Aspects of the invention are directed to these needs.

SUMMARY OF INVENTIONS

With the invention, it has been found that a flame on a candle can be extinguished through application of candle fuel material, such as candle wax, to the burning candlewick to cover at least a significant portion of the surface area of the burning candlewick, thereby extinguishing the flame, and surprisingly with little smoking following flame extinguishment. Moreover, because at least some surfaces of the extinguished candlewick are covered with candle fuel material, which is generally solid at room temperature, the candlewick remains relatively more rigid between lightings and is more apt to resist deformation and to remain erect and easily accessible for relighting. Also, the covering of candle fuel material on the extinguished candlewick provides a ready source of fuel to aid quick and easy ignition of the candle on relighting.

In one aspect, the invention provides a hand-held apparatus useful for extinguishing a flame of a candle burning on an exposed portion of a candlewick of the candle and preparing the candle for relighting following extinguishment. The apparatus is adapted for moving liquid-form candle fuel material, such as melted candle wax, from adjacent the candlewick and applying the candle fuel material to the exposed portion of the candlewick to cover at least a portion of the surfaces of the exposed portion of the candlewick.

Another aspect of the invention provides methods for extinguishing, or putting out, a flame of a candle burning on an exposed portion of a candlewick of the candle. In one variation of a method of the invention, body material of the candle, and preferably candle fuel material, is moved from the candle body to cover a surface of the exposed portion of the candlewick. In another variation of a method of the invention, an apparatus is used to force candle fuel material to contact the exposed portion of the candlewick and to cover at least a portion of the surface of the exposed portion of the candlewick.

DETAILED DESCRIPTION OF INVENTION

Figure 1:
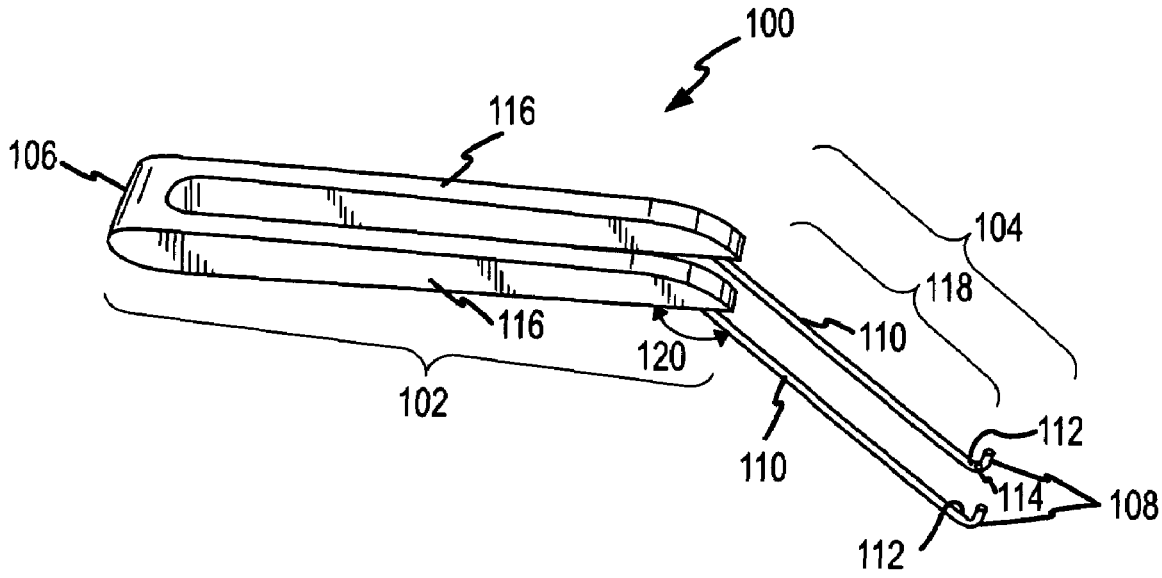
FIG. 1 is a perspective view of one embodiment of an apparatus useful for extinguishing a candle flame, with the apparatus shown in an open position.

One aspect of the invention concerns an apparatus useful in relation to extinguishing candle flames. The apparatus is useful for extinguishing a flame of a lit candle and for preparing the candlewick for relighting following extinguishment. When used to extinguish the flame of a candle, the apparatus is manipulable to cover at least a significant portion, and preferably substantially all, of the burning portion of the candlewick with candle fuel material. In addition to extinguishing the flame, covering the candlewick with candle fuel material facilitates easy relighting of the candlewick. Typically, the candle fuel material is a normally-solid substance and the covering of candle fuel material on the candlewick helps to resist deformation of the candlewick and to maintain rigidity of the extinguished candlewick, tending to maintain the candlewick in an extended position for easy access for relighting. As used herein, candle fuel material means any material used to make a candle body that provides fuel for burning in the flame of the candle when the candle is lit. Traditionally, candles included talow, a wax or some other fatty substance as fuel material. Common candle fuel materials are often generally referred to as "candle waxes". Candle waxes include, for example, petroleum waxes, insect waxes, vegetable waxes, synthetic waxes and gels (often referred to as "gel waxes") used as a fuel material for inclusion in candle bodies. Different candle waxes have different properties and are used for making different types of candles. Typically, however, candle waxes are in a solid form at room temperature and have a melting point within a range from about 110° F. to about 200° F. Petroleum waxes generally are those derived from petroleum, and include, for example, paraffin waxes, microcrystalline waxes and petrolatum. Insect waxes include, for example, beeswax. Vegetable waxes include, for example, bayberry wax, palm wax and soy wax. Synthetic waxes are materials manufactured by chemical synthesis, and include, for example, the so-called Fischer-Tropsch waxes. Gel waxes are generally petroleum-based.

A typical candle has a solid mass (referred to herein as the "candle body"), often having a cylindrical or tapered shape, with a candlewick disposed within the candle body and extending out of at least one end of the candle body. The candle body is typically made primarily of one or more candle fuel materials, as previously described, and may also include lesser quantities of one or more of a variety of additives. Additives are included to modify properties of the candle, such as for example, melting point or rigidity of the candle body, visual appearance, aroma, etc. Additives may or may not also provide fuel for the flame. Examples of some additives include stearic acid vybar, luster crystals, clear crystals, plastic additives, microcrystalline wax, UV inhibitor and mineral oil.

The apparatus of the invention is generally referred to herein as an applicator, because it is used to apply candle fuel material to a candlewick to extinguish a burning flame on the candlewick.

Figure 2:
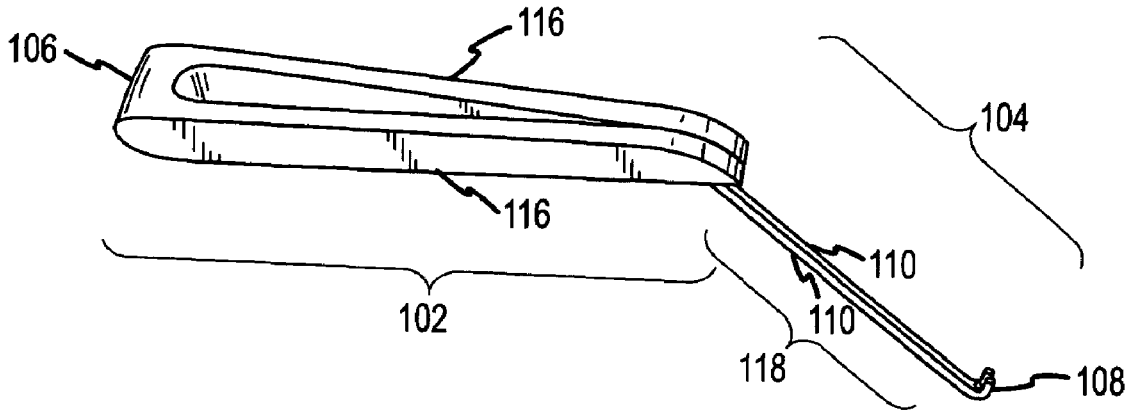
FIG. 2 is a perspective view of the same embodiment of an apparatus as shown in FIG. 1, except with the apparatus in a close position.

Referring now to FIG. 1 and FIG. 2, one embodiment of an applicator of the invention is shown. As shown in FIGS. 1 and 2, an applicator 100 includes a handle portion 102 and an application portion 104. The handle portion 102 is adjacent a proximal end 106 of the applicator 100 and the application portion 104 is adjacent a distal end 108 of the applicator 100. The proximal end 106 is the end that is proximal to the user when the applicator 100 is being used and the distal end 108 is the end away from the user, and that primarily interacts with a candle, during use of the applicator 100. The handle portion 102 is configured to be single-hand grippable, so that a user can grip and manipulate the applicator 100 with one hand. The application portion 104 includes application members 110, each having an application surface 112 thereon. The application surfaces 112 are in opposed relation generally facing each other. The handle portion 102 is manipulable to controllably move the application members 110 to thereby cause movement of the application surfaces 112 toward and away from each other. In particular, the handle portion 102 is manipulable to controllably move the application members 110 between an open position, as shown in FIG. 1, and a close position, as shown in FIG. 2. In the open position, as shown in FIG. 1, the application surfaces 112 are located farther apart, and in the close position, as shown in FIG. 2, the application surfaces 112 are closer together and in close proximity as would be the case when the applicator 100 is being used to extinguish a flame burning on a candlewick.

With continued reference to FIGS. 1 and 2, the application surfaces 112 are the surfaces of the apparatus 100 that interact with a candlewick during use of the apparatus to apply a covering of wax to a candlewick and extinguish a flame burning on the candlewick. The application surfaces 112 are configured to:

(i) be positionable, through manipulation of the handle portion 106, to contact liquid-form candle fuel material of a candle while the application members 110 are in the open position;

(ii) while in contact with the liquid-form candle fuel material as described in (i), clasp about the candlewick below or at the base of the flame when the handle portion 106 is manipulated to move the application members 110 from the open position to the close position with the candlewick located between the application surfaces 112, without extinguishing the flame burning on the candlewick;

(iii) while clasped about the candlewick as described in (ii), be movable, through movement of the handle portion 102, in a direction from the base of the flame toward the tip of the flame while the application surfaces 110 remain clasped about the candlewick; and (iv) spread portions of the liquid-form candle fuel material over the burning portion of the candlewick when the application surfaces 112 are moved in a direction from the base of the flame toward the tip of the flame as described in (iii), to thereby apply a covering of the candle fuel material to the burning portion of the candlewick to extinguish the flame and prepare the candlewick for relighting.

Figure 3:
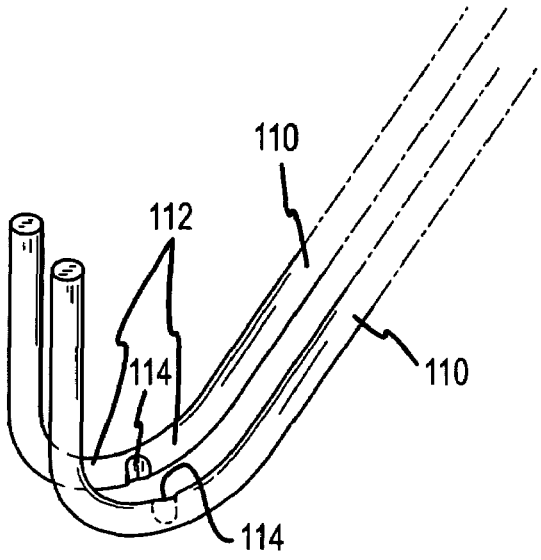
FIG. 3 is a perspective view of a portion of one embodiment of an apparatus useful for extinguishment of a candle flame showing one embodiment for application surfaces.

As shown in FIG. 1, each of the application surfaces 112 has a corresponding and opposing recess portion 114 designed to assist application of candle fuel material to a candlewick when the applicator 100 is used to extinguish a candle. A closer view of the application surface 112 and the recess portion 114 of the applicator 100 is shown in FIG. 3. As shown in FIGS. 1 and 3, the recess portion 114 is an arcuate notch in the application member 110. The shape of the recess portion 114 is designed to receive at least a portion of the thickness of a candlewick when the application members are in the close position with the application surfaces 112 clasped about the candlewick, as described in item (ii) above, and as is further described below in a discussion concerning methods of the invention.

The recess portions 114 facilitate easy and effective clasping of the candlewick during use of the applicator 100 and application of candle wax to cover surfaces of the candlewick. The recess portions 114 help to maintain the candlewick in a proper position relative to the application surfaces 112 for application of candle wax by the application surfaces 112 to the surface of the candlewick.

By "application surfaces", it is meant the surfaces that carry candle wax for application to the candlewick and/or that force the candle wax to contact surfaces of the candlewick. The recess portions 114 are part of the application surfaces 112 of the applicator 100 shown in FIGS. 1-3. The recess portions 114 are preferably generally sized to roughly correspond with the thickness of a candlewick. In that regard, the opening between and through the recess portions 114 when the application members 110 are brought into closest possible positioning is preferably of an order of magnitude corresponding to the thickness of a candlewick, and more preferably within a range from slightly smaller to slightly larger than the thickness of a candlewick. In one preferred embodiment, the recess portions 114 have a maximum depth, being the dimension of maximum recess or setback from unrecessed adjacent portions of the application surface 112, in a range of from 0.5 mm to 5 mm (and more preferably in a range of from 1 to 3 mm), and a width, being a maximum dimension across the recess portion 114 in a direction perpendicular to the direction that a candlewick would extend through the recess portion 114 during use, preferably in a range of from 0.5 mm to 5 mm (and more preferably in a range of from 1 to 3 mm).

One enhancement included in the applicator 100 is that the application members 110 have a cross-sectional shape (taken in the vicinity of the application surfaces 112 across the thickness of the application member 110) so that when a candlewick is extending between the application surfaces 112 when the application members 110 are in a close position with the application surfaces 112 clasped about the candlewick, the distance between the application surfaces 112 increases in a longitudinal direction of a candlewick moving toward the tip of the flame over at least a portion of the thickness of the application members. This increasing standoff between the application surfaces 112 when in the close position is provided by the generally circular cross-sectional shape across the thickness of the application members 110, with the tops of the application surfaces 112 (corresponding to the tops of the application members 110) being located farther apart than the center portions of the application surfaces 112 (corresponding to the middle portions of the application members 110). This broadening gap between the application surfaces 112 provides a space for candle wax to accumulate and be carried, and to be available for application to the surface of a candlewick when the applicator 100 is used to extinguish a candle flame.

Figure 4:
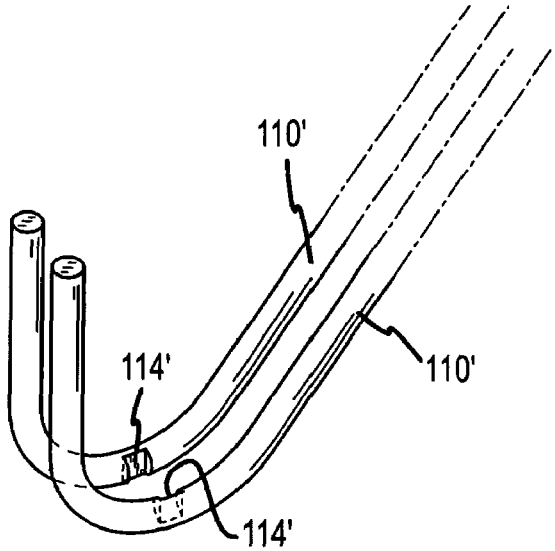
FIG. 4 is a perspective view of a portion of one embodiment of an apparatus useful for extinguishment of a candle flame showing one embodiment for application surfaces.
Figure 5:
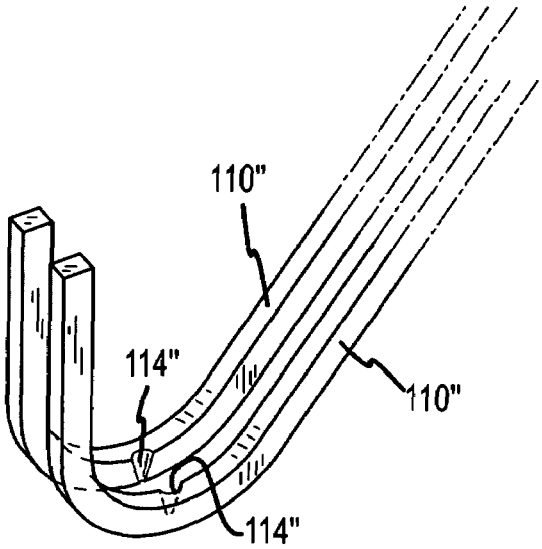
FIG. 5 is a perspective view of a portion of one embodiment of an apparatus useful for extinguishment of a candle flame showing one embodiment for application surfaces.
Figure 6:
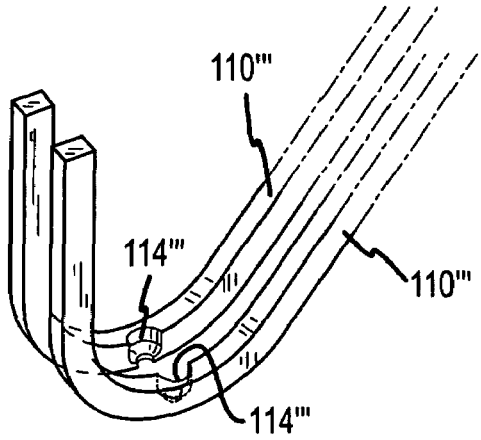
FIG. 6 is a perspective view of a portion of one embodiment of an apparatus useful for extinguishment of a candle flame showing one embodiment for application surfaces.

The embodiment of the application members 110 and the application surfaces 112, including the recess portions 114, shown in FIGS. 1-3 are exemplary only, and not exclusive configurations for those features. FIGS. 4, 5 and 6 show some exemplary alternative embodiments. The recess portion 114' as shown in FIG. 4 is of a rectilinear configuration recessed some depth into the application members 110', which have a round cross-section similar to that described for the application members 110 shown in FIGS. 1-3, so that the application surfaces diverge in a direction moving toward the tops of the application surfaces 112, providing space for accumulation of candle wax when the application members 110 are in a close position for extinguishing a candle. FIGS. 5 and 6 show other exemplary configurations including application members 110" and 110''', respectively, that have a square cross-sectional shape, rather than a round cross-sectional shape as shown in FIGS. 1-4. Even though the application members 110" and 110''' shown in FIGS. 5 and 6 have a square cross-sectional shape, the shape of the corresponding recess portions 114" and 114''' of and those embodiments include a shape that provides a divergent surface configuration providing a space for accumulation of wax for application to a candlewick when the application members are in the close position as used to extinguish a candle flame. The recess portion 114" shown in FIG. 5 has a shape that is a section of a cone, that widens in a direction moving up across the thickness of the corresponding application member 110". An opening at the bottom of the conical section (at the bottom of the recess portion 114") accommodates clasping about a candlewick, and the wider portion of the conical section of recess portion 114" (moving toward the top of the recess portion 114") provides a space for holding candle wax about a candlewick available for application to surfaces of the candlewick during use. The recess portion 114''' shown in FIG. 6 has a "bowl" shape that opens in an upward direction across the thickness of the corresponding application member 110'''. Similar to the configuration shown in FIG. 5, an opening at the bottom of the "bowl" shape (at the bottom of the recess portion 114''') accommodates clasping about a candlewick and the wider upper portion of the "bowl" shape (moving toward the top of the recess portion 114''') provides a space for holding candle wax about a candlewick available for application to surfaces of the candlewick during use.

Reference is again made to FIGS. 1-3. As shown in FIG. 1, the applicator 100 is configured so that when the applicator 100 is in an at-rest position the application members 110 are mechanically biased in the open position. The applicator 100 includes two actuation members 116 fixedly positioned in relation to one another at the proximal end 106. The actuation members 116 are positioned and adapted for single hand grasping and squeezing by a user to overcome the mechanical bias and force movement of the actuation members 116 from the at-rest position to force the application members 110 to move to the close position, as shown in FIG. 2. In the embodiment of the applicator 100, the actuation members are contilevered and designed to flex and reversibly deform to move closer together toward the distal end 108 as the actuation arms are squeezed by a user. When the user then discontinues squeezing the actuation members 116 together, the actuation members 116 (and consequently the application members 110) automatically return to the at-rest position biased to be in the open position, as shown in FIG. 1. This biased-open feature of the applicator 100 is an enhancement that facilitates easy use of the applicator 100 to locate the application surfaces 112 adjacent a candlewick for clasping the application surfaces 112 about the candlewick and then manipulating the applicator 100 to easily extinguish the flame on a candle.

Another enhancement included in the embodiment of the applicator 100 shown in FIGS. 1 and 2 is the configuration of the handle portion 102 in relation to the application portion 104 of the applicator 100. As shown in FIGS. 1 and 2, the application members 110 have longitudinally extending portions that extend downward and away from the handle portion 102 so that when the applicator 100 is used in normal fashion to extinguish a candle, the end of the handle portion closest the flame will be located significantly above and horizontally back from the application surfaces 112 and the flame of the candle (which will be located in the vicinity of the application surfaces 112 during use). This permits a user to extinguish the candle without placing the user's hand above or in close horizontal proximity to the flame where the hand is more susceptible to being burned during use. In the embodiment of the applicator 100 showed in FIGS. 1 and 2, the vertical and horizontal standoff from the flame is accomplished by a configuration in which the application members 110 have an extension portion 118 located between the handle portion 102 and the application surfaces 112, which extension portions 118 are located to longitudinally extend at an obtuse angle 120 relative to the corresponding actuation member 116 of the handle portion 102. It should, however, be recognized that other configurations of the handle portion 102 in relation to the application portion 104 could accomplish the same vertical and horizontal standoff. Moreover, the vertical and horizontal standoffs between the application surfaces 114 and the handle portion 102 may advantageously be varied depending upon the type of candle being extinguished and whether the burning candlewick to be reached is located deep within a container into which a user must reach in order to extinguish the candle. The embodiment of the applicator 100 as shown in FIGS. 1 and 2 is well-suited for a large variety of applications, accommodating a number of different candle configurations and including candles located within a container, provided that the depth of reach into the container does not become excessive. In one preferred implementation of the embodiment shown in FIGS. 1 and 2, each of the extension portions 118 of the application members 110 are oriented so that the longitudinal direction of each of the extension portions 118 extends at an obtuse angle with respect to the corresponding actuation member 116, and more preferably in a range having a lower limit selected from the group consisting of 100°, 120° and 140° and an upper limit selected from the group consisting of 170°, 150° and 130°, provided that the upper limit is larger than the lower limit. Also in another preferred implementation of the embodiment shown in FIGS. 1 and 2, the application members 110, the application surfaces 112 and the handle portion 102 are configured so that during normal use of the applicator 100 to extinguish a candle, the part of the handle portion 102 grasped by a user that is closest to the flame is located horizontally away from the application surfaces 112 at least 2 cm, preferably at least 3 cm and more preferably at least 5 cm (but often no more than 20 cm) and vertically above the application surfaces 112 at least 1 cm, preferably at least 2 cm, and often 5 cm or more. As will be appreciated. The preferred vertical distance may be affected by the depth to which the application members 110 must reach to access the candlewick during use. Often, however, the vertical dimension will be smaller than 20 cm. If the applicator 100 were designed to reach into a relatively narrow container to extinguish a flame deep within the container, the application members may have much longer extension portions 118 and the angle between such extension portions 118 and the actuation members 116 may approach or even be at a right angle, or even an acute angle, provided that the actuation members 116 are sufficiently long to keep the user's hand safely away from being directly over the heat of the flame to be extinguished, and preferably outside of the periphery of the candle container, when the applicator 100 is used to extinguish such a flame.

Another enhancement shown in the embodiment of the applicator 100 shown in FIGS. 1 and 2, is inclusion of a hook portion at the end of the application members 110 adjacent the distal end 108 of the applicator 100, with each recess portion 114 of the application surface 112 located on the bend of the hook portion. The hook portion of the application members 110 are advantageous to assist a user to readily locate the application surfaces 112 at the proper location adjacent a candlewick having a flame to be extinguished. This is because during use of the applicator 100, the application surfaces 112 (and particularly the recess portions 114) preferably become wholly, or at least partially, immersed in melted candle wax at the surface of the candle to be extinguished, and the tip portions of the hook end are easy to see when immersing the application surfaces 112 in the melted candle wax. In one preferred embodiment, the recess portion 114 is located at least 2 mm, more preferably at least 4 mm and even more preferably at least 6 mm, from the terminal end of the hook portion.

Figure 7:
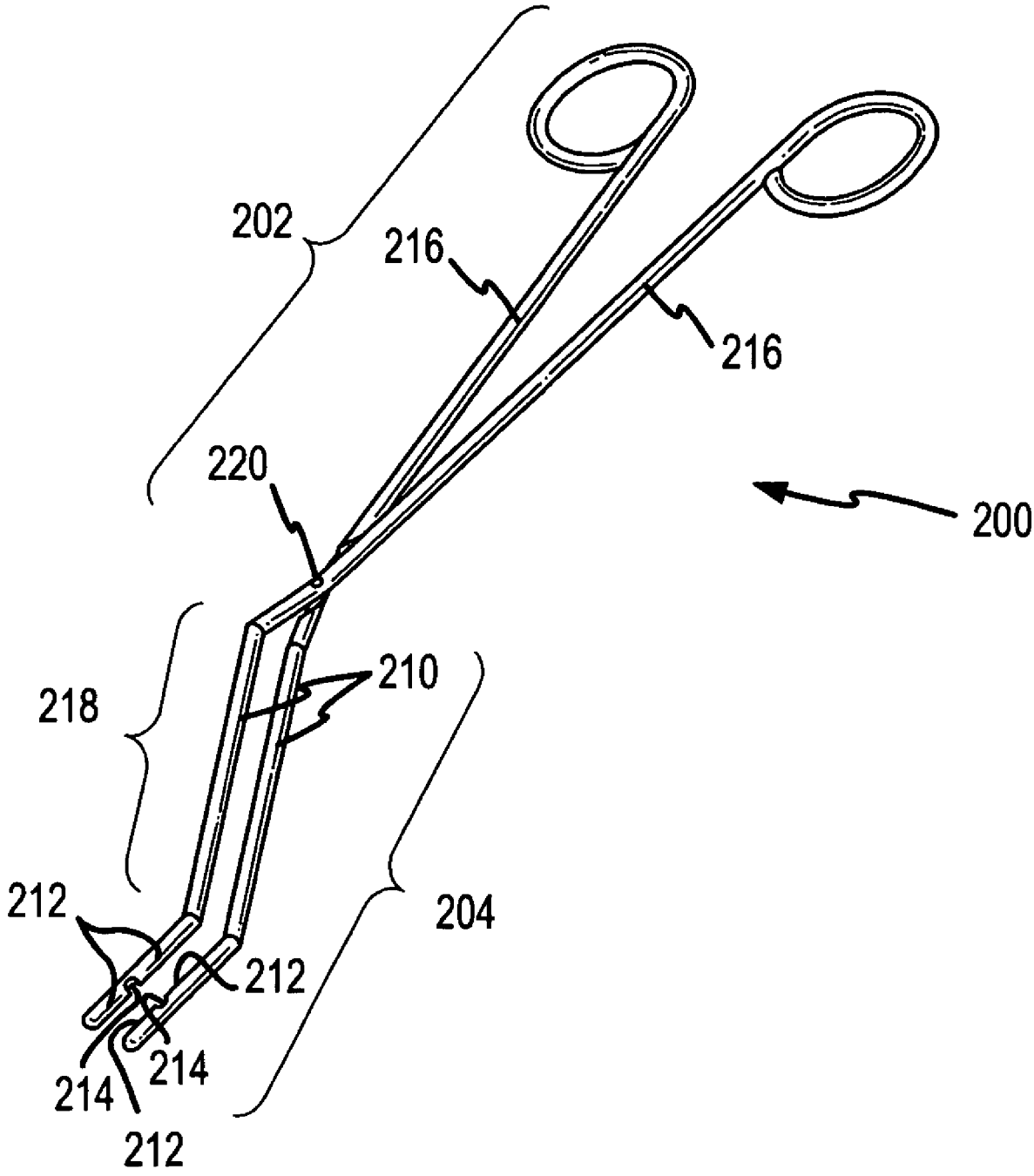
FIG. 7 is a perspective view of an embodiment of an apparatus useful for extinguishing a candle flame.
Figure 8:
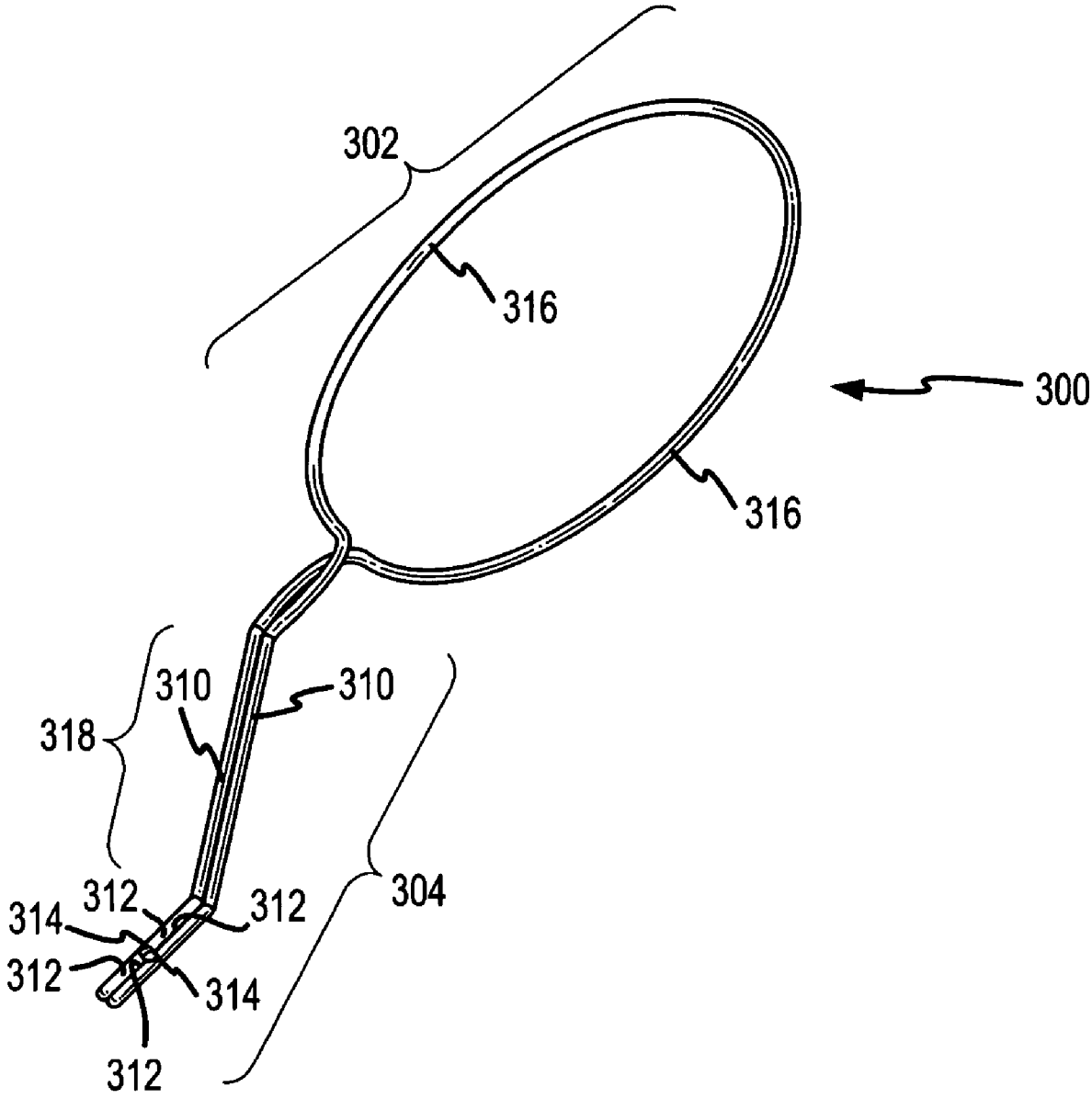
FIG. 8 is a perspective view of an embodiment of an apparatus useful for extinguishing a candle flame.

The embodiments described with reference to FIGS. 1-6 are only examples including some configurations for the applicator of the invention. Some other exemplary embodiments for the applicator of the invention are shown in FIGS. 7 and 8. In FIG. 7, an applicator 200 is shown including a handle portion 202 and an application portion 204. The handle portion 202 includes actuation members 216 that are pivotable in a scissor-like manner about a pivot pin 220 to cause movement of corresponding application members 210, each of which has an application surface 212 that includes a recess portion 214. Each of the application members 210 has an extension portion 218 oriented so that the longitudinal direction of each of the extension portions 218 is oriented at an obtuse angle with respect to the corresponding actuation member 216. The applicator 200 shown in FIG. 7 is configured so that it is not biased in an open or a close position when it is at-rest. Such a configuration could, however, be easily modified to be biased open by including a spring between the actuation members 216 to push the members 216 apart when at-rest.

In FIG. 8, an applicator 300 is shown including a handle portion 302 and an application portion 304, and that is configured to be mechanically biased in a close position when at-rest. The handle portion 302 includes actuation members 316 each connected to a corresponding application member 310. Each of the application members 310 has an application surface 312 that includes a recess portion 314. Each of the application members 310 has an extension portion 318 oriented so that the longitudinal direction of each of the extension portions 318 is oriented at an obtuse angle with respect to the corresponding actuation members.

As noted, the applicator 300 shown in FIG. 8 is configured to be mechanically biased in a close position when at-rest. During use, a user would grip the handle portion 302 and squeeze the actuation members 316 to force the application members 310 to an open position with the application surfaces 312 located father apart to permit positioning of the application surfaces about a candlewick. The user would then stop squeezing the actuation members 316 to permit the application members 310 to close to clasp the application surfaces 312 about the candlewick, preferably with the candlewick passing through the recess portions 314.

Figure 9:
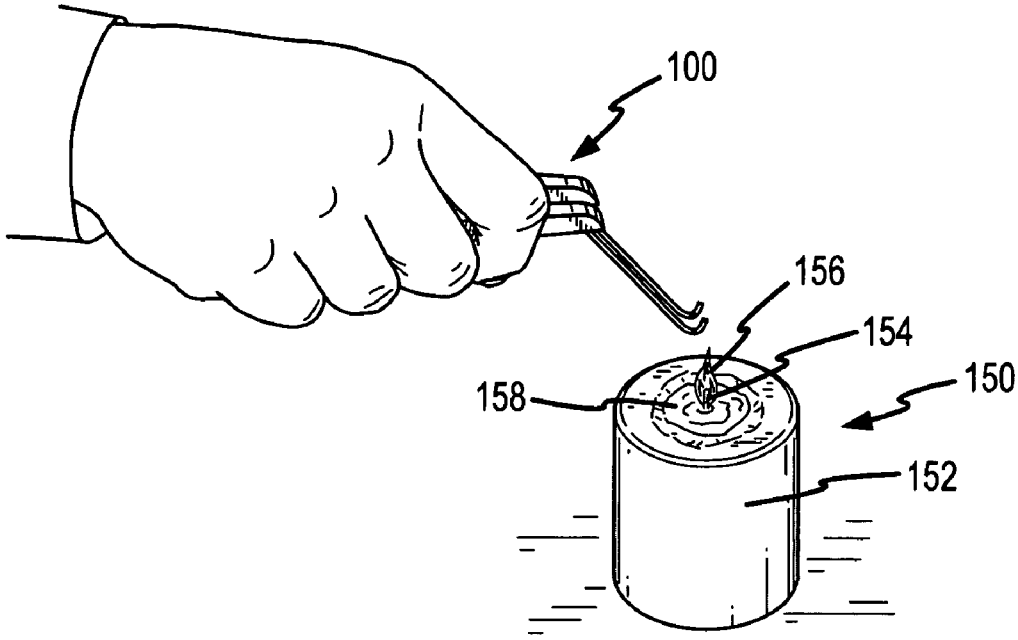
FIG. 9 is a perspective view showing a user preparing to use an apparatus for extinguishing a flame on a candle.
Figure 10:
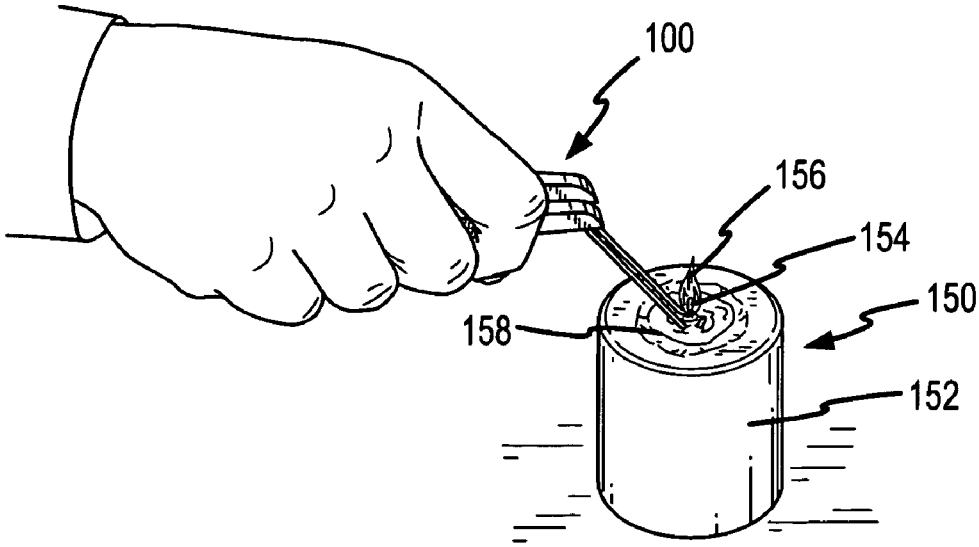
FIG. 10 is a perspective view showing a user locating an apparatus for use to extinguish a flame on a candle.
Figure 11:
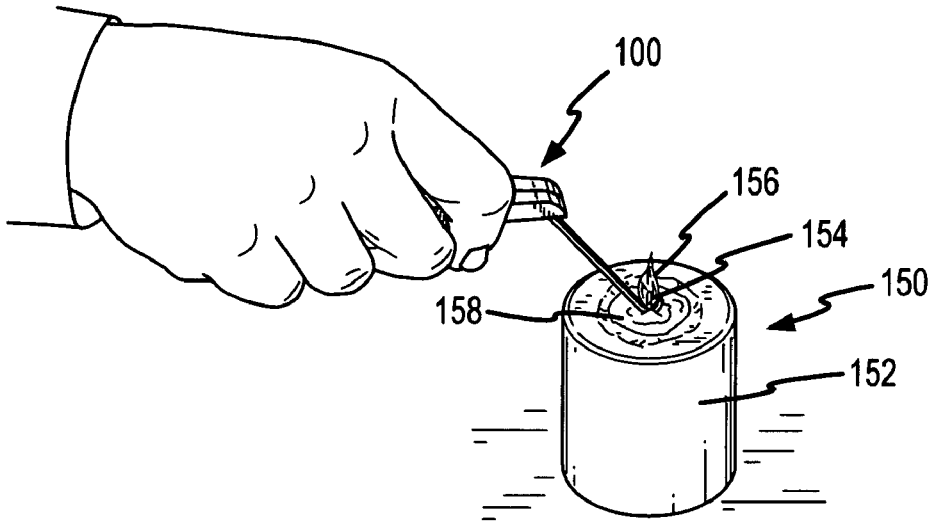
FIG. 11 is a perspective view showing a user manipulating an apparatus during extinguishment of a flame on a candle.
Figure 12:
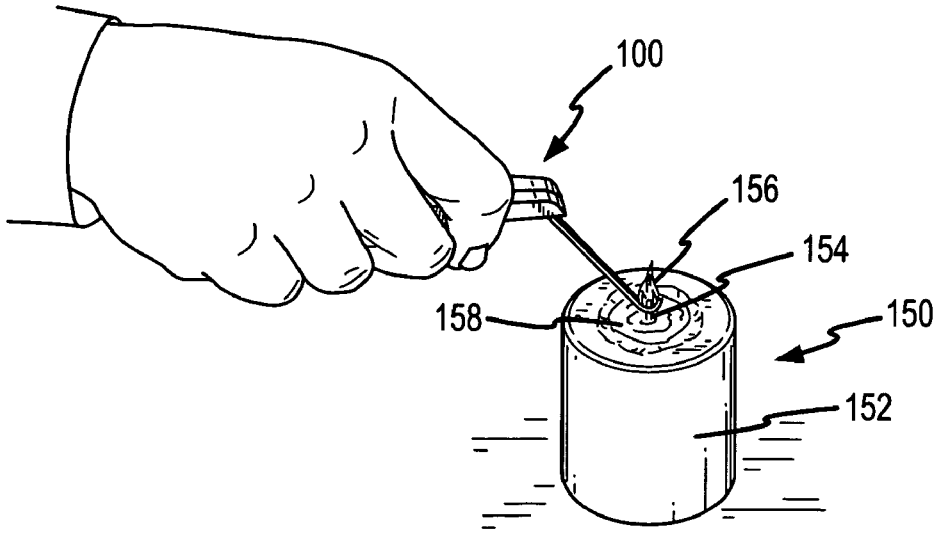
FIG. 12 is a perspective view showing a user manipulating an apparatus during extinguishment of a flame on a candle.
Figure 13:
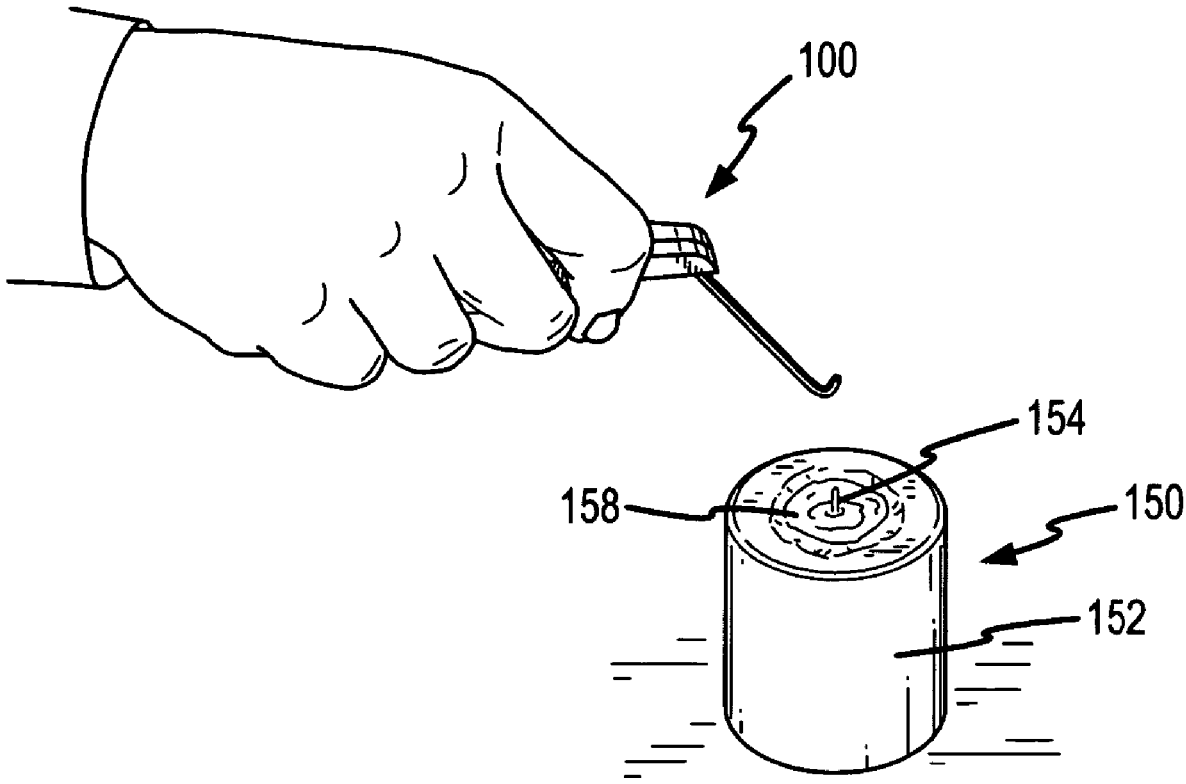
FIG. 13 is a perspective view showing a user with an apparatus following completion of extinguishment of a candle flame.

One aspect of the invention concerns methods for extinguishing a flame of a candle. One implementation for a method of the invention will now be described with reference new to FIGS. 9-13 (and to FIGS. 1-3 as needed). As shown in FIG. 9, a candle 150 has a body portion 152 and a candlewick 154 with an exposed portion extending from the top of the body portion 152. A flame 156 is burning on the exposed portion of the candlewick 154. In FIG. 9, the applicator 100 is shown being held by the hand of a user prior to commencing the process of extinguishing the flame 156. At the top of the body portion 152 of the candle 150, adjacent the candlewick 154, is an accumulation of liquid-form candle wax of the body portion 152 that has been converted to the liquid-form through melting via heat from the flame 156. In FIG. 10, the applicator 100 is shown positioned at or below the base of the flame 156 with the application surfaces 112 at least partially submerged in the liquid-form candle wax 158, thereby wetting at least portions of the application surfaces 112 with melted candle wax. With the applicator 100 positioned as shown in FIG. 10, the recess portions 114 of the application surfaces 112 are located on opposite sides of the thickness of the candlewick 154. FIG. 11 shows the applicator 100 after manipulation by the user to move the application members 110 to the close position with the application surfaces 112 clasped about the candlewick 154 and in contact with the liquid-form candle wax 158. FIG. 12, shows the applicator 100 being raised to move the application surfaces 110 upward along the length of the exposed portion of the candlewick 154 in the direction of the flame 156. As the application surfaces 112 move upward along the length of the exposed portion of the candlewick 154, the application surfaces 112 force candle wax collected from the liquid-form candle wax 158 to be spread along and cover surfaces of the exposed portion of the candlewick 154, extinguishing the flame 156 from the bottom up. FIG. 13 shows the applicator 100 after it has been manipulated to have moved the application surfaces 112 over the complete length of the exposed portion of the candlewick 154 to apply candle wax collected from the liquid-form candle wax 158 to cover surfaces along the entire length of the exposed portion of the candlewick 154, and FIG. 13 shows the flame having been extinguished. In this way, a portion of the body material, namely a portion of the candle wax collected from the liquid-form candle wax 158, has been moved by the applicator 100 away from the body portion 152 of the candle 150 to cover a surface of the exposed portion of the candlewick 154, thereby extinguishing the flame, and advantageously with little or no significant smoking following extinguishment. Moreover, by covering a surface of the exposed portion of the candlewick 154 with candle wax, the exposed portion of the candlewick 154 is advantageously prepared for easy relighting. The easy relighting is facilitated by the presence of the candle wax that has been applied to the exposed portion of the candlewick 154, providing fuel to promote quick ignition of a flame upon relighting. Also, as the candle wax applied to the exposed portion of the candlewick 154 solidifies upon cooling, the rigidity of the solid-form tends to maintain the exposed portion of the candlewick 154 in an extended position that resists deformation, and promoting ready accessibility of the candlewick 154 for relighting.

The foregoing discussion of the invention has been presented for purposes of illustration and description. The foregoing is not intended to limit the invention to only the form or forms specifically disclosed herein. Although the description of the invention has included description of one or more possible implementations and certain variations and modifications, other variations and modifications are within the scope of the invention, e.g., as may be within the skill and knowledge of those in the art after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

Furthermore, any feature described with respect to any disclosed implementation may be combined in any combination with any one or more other feature(s) described with respect to any other disclosed implementation or implementations, to the extent that the features are not necessarily technically incompatible, and all such combinations are contemplated as within the scope of the present invention. Without limiting the general applicability of the foregoing, any one or more of the apparatus features disclosed in any of FIGS. 1-8 may be combined in any combination with any other of the disclosed apparatus features. For example, different designs for application surfaces and/or recess portions and/or application members and/or handle may be combined in any combination. Also without limiting the generality of the foregoing, any apparatus features shown in any of FIGS. 1-8 may be used in the any of the methods described herein, including the descriptions made with reference to FIGS. 9-13. Moreover, any additional apparatus/method features may be added to those described herein provided that each such additional feature is not necessarily technically incompatible with the other features. Furthermore, the claims appended below set forth some nonlimiting combinations of features within the scope of the invention, but also contemplated as being within the scope of the invention are all possible combinations of the subject matter of any two or more of the claims, in any possible combination, provided that the combination is not necessarily technically incompatible.

The terms "comprise", "include", "have" and "contain", and variations of those terms, are intended to indicate only that a particular feature or attribute is present, and are not intended to limit the presence of other features or attributes.

What is claimed is:

1. A method for putting out a flame of a candle, the method comprising:

extinguishing the flame;

immediately prior to the extinguishing, the candle comprising:

(i) a candle body comprising body material;

(ii) a candlewick, comprising an unexposed portion disposed within the candle body and an exposed portion not disposed within the candle body and extending out of the candle body;

(ii) the flame burning on the exposed portion of the candlewick;

wherein the extinguishing comprises moving a portion of the body material from the candle body to cover at least a portion of the surface of the exposed portion of the candlewick, the moving a portion of the body material comprising:

spreading the portion of the body material over the surface of the exposed portion of the candlewick with an applicator; and contacting a contact portion of the applicator with the candle body and thereafter moving the contact portion away from the candle body along with the portion of the body material in a direction along the length of the exposed portion of the candlewick to spread the portion of the body material over the surface of the exposed portion of the candlewick;

and wherein:

the contact portion of the applicator comprises opposed application surfaces controllably movable toward and away from each other to decrease and increase distance between the application surfaces; and the moving the contact portion of the body material comprises moving the application surfaces in a direction away from the candle body along the length of the exposed portion of the candlewick while the application surfaces are disposed on opposite sides of the candlewick.

2. The method of claim 1, wherein the applicator comprises a handle portion manipulable to controllably move the application surfaces toward and away from each other, and the method comprises:

manipulating the handle portion to move the application surfaces closer together during the contacting.

3. The method of claim 2, wherein the application surfaces are normally biased in an open position and the manipulating comprises moving the application surfaces closer together against the bias.

4. The method of claim 1, wherein the application surfaces spread the portion of the body material over the surface of the exposed portion of the candlewick during the moving the application surfaces.

5. The method of claim 1, wherein immediately prior to the contacting, the portion of the body material is in liquid form exposed at a surface of the candle body adjacent the exposed portion of the candlewick.

6. The method of claim 5, wherein the liquid form is a melted portion of the body material.

7. The method of claim 6, wherein the body material supplies fuel for the flame.

8. The method of claim 6, wherein the body material is candle wax.

9. A method for extinguishing a flame on a candlewick and preparing the candlewick for relighting, the method comprising:

applying candle fuel material to an exposed portion of the candlewick on which the flame is burning;

the applying comprising:

(i) locating two or more application surfaces of an applicator adjacent the exposed portion of the candlewick; and (ii) with the application surfaces located adjacent the exposed portion of the candlewick and in the presence of the candle fuel material, moving the application surfaces in the direction of the flame along a length of the exposed portion of the candlewick with the application surfaces each causing a forcing of a portion of the candle fuel material to contact the exposed portion of the candlewick to cover at least a portion of the exposed portion of the candlewick with the portion of the candle fuel material;

wherein the locating comprises clasping the exposed portion of the candlewick between the application surfaces.

10. The method of claim 9, wherein during the moving the application surfaces, the application surfaces are moved in the direction of the flame along the length of the exposed portion of the candlewick while the exposed portion of the candlewick is clasped between the application surfaces.

11. The method of claim 10, wherein the locating comprises, prior to the clasping, contacting the application surfaces with liquid candle fuel material located adjacent the exposed portion of the candlewick.

12. The method of claim 11, wherein:

the application surfaces comprise two application surfaces, a first application surface and a second application surface; and the first and second application surfaces are located on opposite sides of the exposed candlewick during the clasping and the moving the application surfaces.

13. The method of claim 11, wherein the liquid candle fuel material comprises melted candle wax.

14. The method of claim 11, wherein at least one of the first application surface and the second application surface has a recess portion for receiving a portion of the exposed portion of the candlewick when the exposed portion of the candlewick is clasped between the application surfaces during the clasping.

15. The method of claim 11, wherein each of the first application surface and the second application surface has a recess portion that is complementary to the recess portion on the other of application surfaces, wherein a portion of the exposed portion of the candlewick is received in each of the complementary recess portions when the exposed portion of the candlewick is clasped between the application surfaces during the clasping.

16. The method of claim 10, wherein:

the applicator comprises a proximal end adjacent the hand of a user of the applicator during the clasping, and the applicator comprises a distal end adjacent the exposed portion of the candlewick during the clasping, the application surfaces located adjacent the distal end of the applicator.

the applicator comprises a handle portion located adjacent the proximal end;

the handle portion being manipulable to move the application surfaces toward and away from each other about the exposed portion of the candlewick during the clasping.

* * * * *

UNITED STATES PATENT AND TRADEMARK OFFICE

CERTIFICATE OF CORRECTION

PATENT NO. : 7,517,216 B2
APPLICATION NO. : 11/331641
DATED : April 14, 2009
INVENTOR(S) : Levesque It is certified that error appears in the above-identified patent and that said Letters Patent is hereby corrected as shown below:

Column 3, line 8, delete “talow” and insert therefor --tallow--.
Column 6, lines 22 and 23, delete “contilevered” and insert therefor --cantilivered--.

Signed and Sealed this

Second Day of June, 2009

JOHN DOLL
*Acting Director of the United States Patent and Trademark Office*